US008356552B2

(12) United States Patent
Clark et al.

(10) Patent No.: US 8,356,552 B2
(45) Date of Patent: Jan. 22, 2013

(54) SURFACE TRACKING ROTARY PAD PRINTING APPARATUS AND METHOD

(76) Inventors: Lloyd Douglas Clark, San Francisco, CA (US); Brian A. Brown, San Francisco, CA (US)

( * ) Notice: Subject to any disclaimer, the term of this patent is extended or adjusted under 35 U.S.C. 154(b) by 919 days.

(21) Appl. No.: 12/124,690

(22) Filed: May 21, 2008

(65) Prior Publication Data

US 2008/0289521 A1 Nov. 27, 2008

Related U.S. Application Data

(60) Provisional application No. 60/939,697, filed on May 23, 2007.

(51) Int. Cl.
*B41F 17/34* (2006.01)

(52) U.S. Cl. ..... 101/41; 101/35

(58) Field of Classification Search ..... 101/35, 101/41, 44, DIG. 40, 33, 43, 163, 328, 492, 101/493, 42, 401
See application file for complete search history.

(56) References Cited

U.S. PATENT DOCUMENTS 6,135,654 A * 10/2000 Jennel ..... 400/61
6,276,266 B1 8/2001 Dietz et al.
6,840,167 B2 1/2005 Clark et al.
7,117,790 B2 * 10/2006 Kendale et al. ..... 101/327
2003/0010229 A1 * 1/2003 Fujita et al. ..... 101/38.1
2003/0136281 A1 7/2003 Clark et al.

FOREIGN PATENT DOCUMENTS

DE 3820340 C1 6/1988
DE 4020223 C1 6/1990

OTHER PUBLICATIONS

Author unknown, "New Padjet (TM) Digital Pad Printing System", Graphics Pro Magazine, Sep.-Oct. 2004.

* cited by examiner

*Primary Examiner* — Ren Yan
*Assistant Examiner* — Marissa Ferguson Samreth

(57) ABSTRACT

In one aspect of a first embodiment, a rotary pad printing system comprises a controller (400), an image source (498) that provides an image to the controller, a rotary pad (200) that is urged to rotate by a first motive source, a monochrome or color ink source or applicator such as an inkjet (215), and an actuator (235, 730). The system has the ability to print onto a flat or uneven surface (410). The controller actuates the ink source, causing it to deposit an ink image (202) onto a rotating pad wheel (200). As the surface moves, the wheel is held in contact with the surface by an actuator (235) or arm (705). As the wheel turns in contact with the surface, the ink image comes into contact with the surface and transfers to it, thereby printing the ink image onto a flat or uneven surface.

22 Claims, 7 Drawing Sheets

SURFACE TRACKING ROTARY PAD PRINTING APPARATUS AND METHOD

CROSS-REFERENCE TO RELATED APPLICATIONS

This application claims priority of our provisional patent application No. 60/939,697, filed May 23, 2007. This application makes reference to several aspects taught in our co-pending patent applications: Ser. No. 11/464,203, filed Aug. 13, 2006; Ser. No. 11/777,166, filed Jul. 12, 2007 and PCT/US07/17925, filed Aug. 13, 2007; Ser. No. 11/558,911, filed Nov. 11, 2006; Ser. No. 11/11/697,171, filed Apr. 5, 2007; Ser. No. 11,852,301, filed Sep. 8, 2007; and Ser. No. 11/951,762, filed Dec. 9, 2006. All of these applications and U.S. Pat. No. 6,840,167 are hereby incorporated by reference.

BACKGROUND

1. Field

The field is pad printing, and in particular rotary transfer pad printing.

2. Prior Art—FIGS. 1 through 3

In the past, rotary pad printing has been used to decorate objects by printing images or text thereon. FIGS. 1 and 2 show top and side views, respectively, of a prior-art rotary pad printing apparatus. In its simplest form, the rotary pad printing apparatus comprises a rotary cliché 100, i.e. a rigid, cylindrical surface etched using well known photolithographic methods (not shown) about 0.03 mm deep with an image to be printed, a cylindrical wheel 107 comprising a resilient or deformable layer 105 that encircles a rigid shaft 106, and an ink source 110 arranged to supply ink to the etched regions of the cliché.

For exemplary proposes, assume that the numbers 1 through 5 are etched in cliché 100. Although numbers are shown here, the image can comprise text, graphics, and even photographic information. Next, cliché 100 is placed into the printing apparatus adjacent wheel 107 as shown in FIGS. 1 and 2, and ink source 110 is filled with ink.

When printing commences, cliché 100 and wheel 107 are driven to rotate against one-another by a known mechanism (not shown). Directions of motion are indicated by the arrows in FIG. 2. A series of objects 115 to be decorated or printed on are arranged to move upward past wheel 107 and in contact with layer 105. As cliché 100 turns, ink from source 110 is doctored into the etched surface of cliché 100 by ink source 110, in well-known fashion.

As cliché 100 turns against wheel 107, image-wise regions of ink 120 are transferred in near-entirety from cliché 100 to wheel 107. As rotation of wheel 107 continues, ink regions 120 are brought into contact with the upper object 115. As ink regions 120 come into contact with object 115, they leave wheel 107 and most of the ink in regions 120 transfers to object 115. Thus the image originally present on cliché 100 is transferred to object 115.

Instead of moving objects 115 with their axes perpendicular to that of wheel 107, objects 115 can have a round or ellipsoid cross-section and can be rotated against wheel 107 with their axes of rotation parallel. This type of transfer motion is shown below.

This prior-art arrangement is suitable only for single-color transfers. If the user wishes to transfer multicolor images, color separations are required and a separate cliché is required for each color. The objects to be decorated must be carefully aligned for subsequent passages through the rotary transfer pad printing apparatus.

Since the image on the cliché is etched, each cliché contains only one image. Changing the image requires etching a new cliché and exchanging the new cliché for the old one. Since this operation is somewhat involved, it is impractical to use the prior-art apparatus to print small runs. In addition, the prior-art apparatus can not change or update each succeeding image.

Since the cliché transfers the etched and inked image to the rotary pad, the length of the image that can be transferred is limited by the circumference of the cliché.

Also the distance between the axis of the rotary pad and the surface supporting the image-receiving object is fixed. The amount of normal force applied at the point of transfer is dependent upon the compressibility and thickness of the rotary pad. This limits the available variation in height of the object to be printed. In many cases, the compressible rubber part of the pad wheel is about 2.5 cm thick. Thus the thickness change on compression from first contact to maximum compression is significantly less than 2.5 cm.

SUMMARY

In accordance with one aspect of a first embodiment, an apparatus and pad for use in a rotary pad printing are provided that accommodate changes in height of the receiving surface that are greater than the useful compressive thickness of the pad. In accordance with another aspect of the embodiment, a system is provided that maintains a constant radial force between the rotary pad and its axis and the surface to which the image is being transferred. In combination with our above-mentioned applications, this enables the printing of continuous, multi-color, and optionally changing images that extend along an uneven receiving surface for distances greater than the circumference of the rotary pad wheel.

DRAWING FIGURES

FIGS. 4 through 6A show an aspect of a first embodiment.

DRAWING FIGURE REFERENCE NUMERAL/S

100 Cliché
105 Layer
106 Shaft
107 Wheel
110 Source
115 Object
200 Wheel
201 Ink
202 Image
205 Shaft
206 Load cell
207 Connection

210 Motor
212 Source
214 Conduit
215 Applicator
220 Bracket
225 Datum
230 Member
235 Actuator
240 Datum
400 Controller
405 Object
410 Surface
415 Conveyor
420 Belt
425 Roller
430 Roller
435 Belt
440 Motor
445 Encoder
447 Roller
449 Belt
450 Connection
455 Connection
460 Connection
465 Encoder
470 Connection
480 Encoder
485 Belt
498 Source
499 Connection
600 Station
602 Droplet
605 Station
610 Connection
700 Axle
705 Arm
706 Extension
707 Counterweight
710 Pivot
715 Plinth
720 Datum
725 Spring
730 Actuator
735 Connection
740 Sensor
745 Connection
800 Tape
810 Marks
900 Sensor
905 Sensor
910 Connection
920 Connection
990 Wheel
991 Arm
992 Encoder
993 Connection
1000 Belt pad
1002 Roller
1004 Roller
1005 Image
1010 Surface
1200 Pad
1205 Shaft
1700 Wheel
1800 Pad
1805 Roller
1806 Shaft
1810 Roller
1811 Shaft
1815 Roller

DESCRIPTION

First Embodiment

Figure 1:
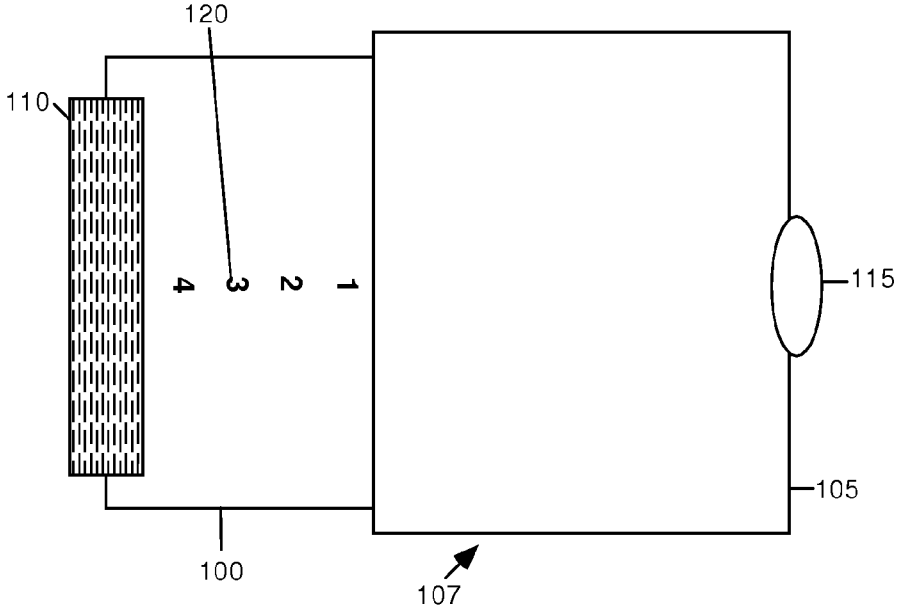
Fig. 1 Prior Art
FIGS. 1 through 3 show a prior-art rotary pad printing system in use.
Figure 2:
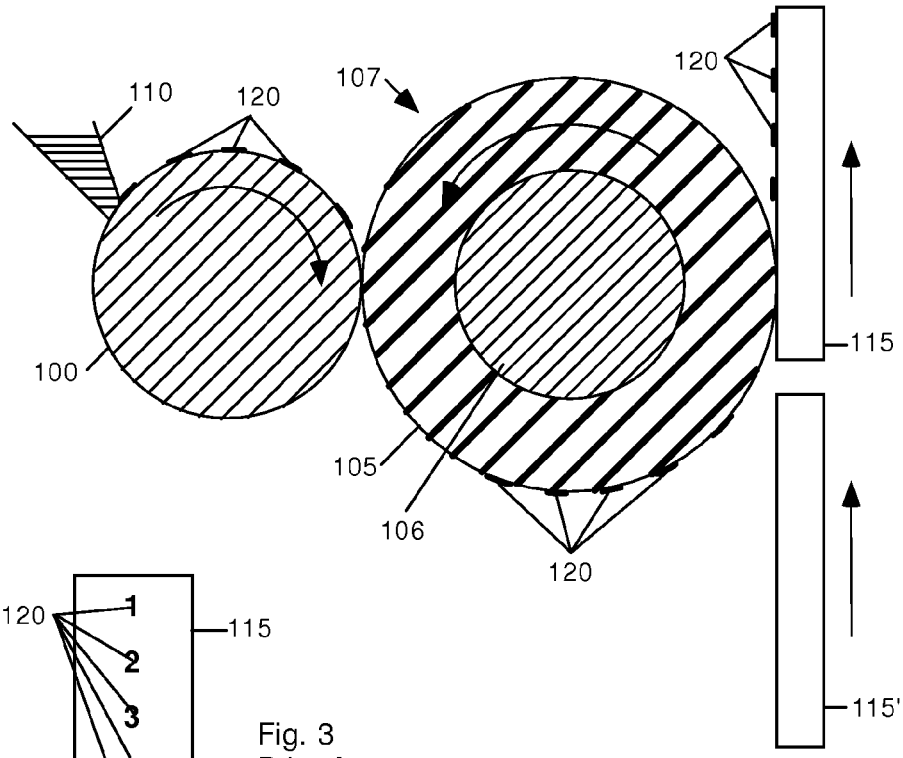
Fig. 2 Prior Art
Figure 3:
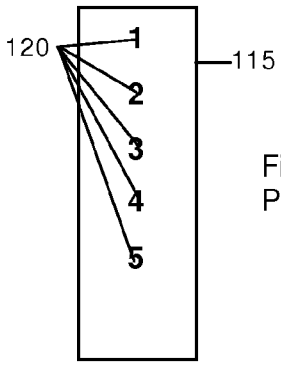
Fig. 3 Prior Art
Figure 4:
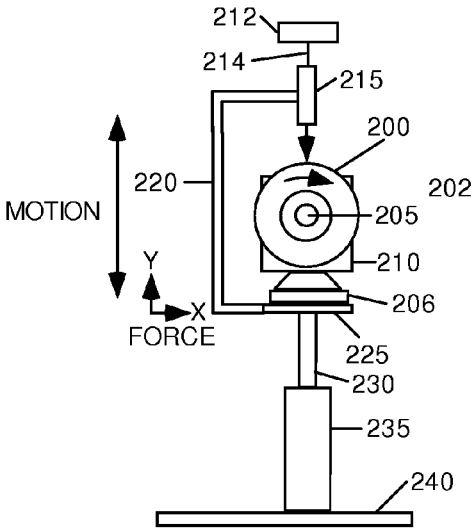
Figure 5:
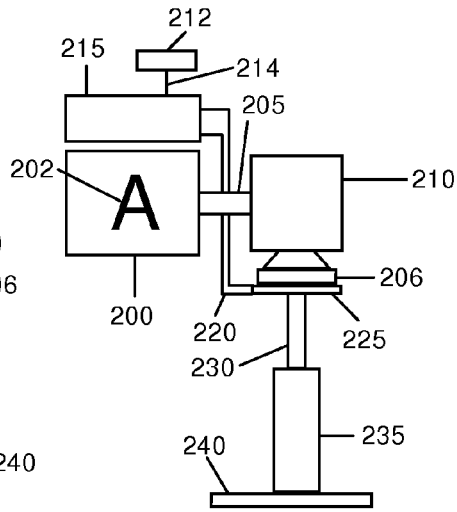

FIGS. 4 through 6

Figure 6A:
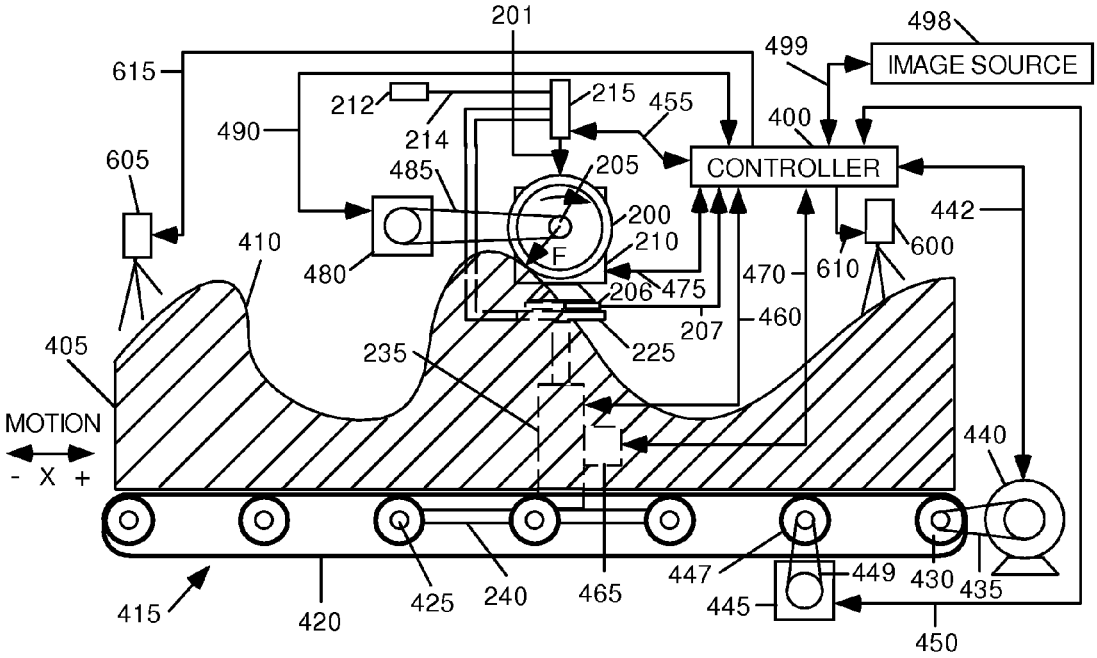

FIG. 4 shows a front view and FIG. 5 shows a side view of one aspect of an embodiment of our pad printing system. In this embodiment, ink is applied to a rotary pad while an actuator maintains contact at a predetermined force between the pad and an irregular surface for transfer of an ink image to the surface (FIG. 6A). A pad printing wheel 200 is mounted on a shaft 205 of a motive source, such as a variable-speed motor 210. The terms pad wheel, pad, and wheel are used equivalently in these descriptions. An ink-coatings and treatment-cleaning applicator 215 is positioned at an operational distance from wheel 200, as taught in our above-mentioned pending patent applications. Applicator 215 includes at least one inkjet. Applicator 215 receives ink and other fluids from a source 212 via a conduit 214. Source 212 can contain a plurality of inks of various colors, varnishes, lacquers, gases, and the like. Motor 210 is mounted on a load cell 206, such as the model F314 two-axis load cell sold by NovaTech Measurements Ltd., East Sussex, England, that senses forces against pad wheel 200 in the X, or horizontal, and the Y, or vertical, directions. The forces sensed by cell 206 are reported to controller 400 (described below) via connection 207.

It is generally a requirement of inkjet heads that they be operated in a vertical position, jetting ink downward or nearly downward. Thus applicator 215 is shown in this position. In the event that another kind of inkjet head is used that does not have the vertically-operating requirement, applicator 215 can be oriented at a different angle, if desired. Applicator 215 is held at a fixed position relative to wheel 200 by a bracket 220. Applicator 215 emits ink 201 (FIG. 4), depositing an ink image (202) onto wheel 200 (FIG. 5). Bracket 220 and motor 210 are affixed to a platform or datum 225. Datum 225 is mounted on a vertically movable member 230. Member 230 is urged up and down by an actuator 235. Actuator 235 can be a jack and member 230 can be a jack screw. Alternatively, actuator 235 can be a pneumatic or hydraulic cylinder and member 230 can be attached to a piston (not shown) within actuator 235. In another alternative aspect, actuator 235 and member 230 can be replaced by a series of pulleys and chains or levers. Actuator 235 is affixed to a second datum 240.

FIG. 6A shows the embodiment of FIGS. 4 and 5 prepared for use. An object 405 with a surface 410 is placed on a conveyor 415. Optional pre-and post-treatment stations 600 and 605 are positioned to apply well-known coatings, inks, gases, air flow, and ionizing or electromagnetic radiation such as microwaves or light, including visible, ultraviolet, and infrared light, heat, and ultrasound to a surface 410 before and after application of an image by wheel 200 (described below). Station 600 receives commands from a known controller, such as a microprocessor or microcomputer, 400 via a connection 610. Station 605 receives commands from controller 400 via connection 615. Stations 600 and 605 can be arranged to apply treatments on a narrow line-at-a-time basis, or over a larger region containing many lines. Although object 405 and conveyor 415 are shown as having nearly the same length for clarity, conveyor 415 is typically longer than object 405 in order to permit the full length of object 405 to pass beneath applicator 215 and stations 600 and 605.

Motor 210, applicator 215, and actuator 235 all operate under the control of controller 400. In addition, motor 210, applicator 215, and actuator 235 optionally send known signals to controller 400, thereby providing feedback about their operational parameters such as position, torque, temperature, completed operations, and the like.

In one aspect of the present embodiment, an object 405 has a surface 410 that is to receive an image transferred from the surface of wheel 200. Object 405 is secured on conveyor system 415. Conveyor 415 comprises a belt 420 and a series of idler rollers 425. Rollers 425 support belt 420 and object 405. Belt 420 is driven in a horizontal direction, either to the left, indicated by the −X, or to the right, indicated by the +X, by roller 430.

Roller 430 is coupled to a motive source or motor 440 by a known mechanical driving means, such as gears, a shaft, a belt, or a chain 435. Motor 440 is driven by signals from controller 400. Motor 440 also optionally provides torque information feedback to controller 400 via connection 442. For example, the amount of current required to operate motor 440 is directly related to the torque exerted by motor 440. Thus controller 400 can use information fed back from motor 440 to determine the force required to move object 405 in the +X or the −X direction. Depending upon the shape of surface 410 and the torque exerted by motor 210, the force required to move object 405 can be positive or negative. Thus, motor 440 can exert force in either the −X or +X direction in order to maintain a constant normal force between wheel 200 and surface 410 of object 405.

An optional rotary encoder 445 is coupled to a roller 447 by a belt 449 or other means. Roller 447 rotates in contact with belt 420 and by calculation, encoder 445 can report the horizontal position of belt 420 to controller 400 via connection 450. Optionally roller 447 may contain a gear to engage a track on the belt to assure proper synchronization.

Controller 400 also sends and optionally receives information from applicator 215 via connection 455. For example, controller 400 can instruct applicator 215 to apply ink or coatings to the surface of wheel 200. A rotary encoder 480 is attached to shaft 205 of wheel 200 by a belt, chain, or other mechanism 485. Encoder 480 can also be coupled directly to shaft 205, if desired. Encoder 480 reports the rotational position of wheel 205 to controller 400 via connection 490.

Controller 400 also causes actuator 235 to raise and lower datum 225 via connection 460. An optional encoder mechanism 465 reports the vertical position of datum 225 to controller 400 via connection 470. In addition, encoder 465 can also report the amount of vertical force being exerted against wheel 200 by surface 410 of object 405.

Controller 400 further operates motor 210 via connection 475. As described above in connection with motor 440, controller 400 is aware of the torque exerted by motor 210 by virtue of the amount and direction of current required to operate motor 210.

Wheel 200 can be made of any durable elastomer, such as silicone rubber, caoutchouc, latex, gelatin, or alginate that has properties suitable for pad printing. Its hardness value can be in the range of 5 to 85 durometer (Shore). In this aspect of the embodiment, the diameter and width of wheel 200 are 20 cm and 5 cm, respectively. All other components are scaled accordingly as indicated in FIGS. 5 and 6. The speed of rotation of wheel 200 is between 0.1 and 100 RPM, although other speeds can be used.

OPERATION

First Embodiment

Figure 6B:
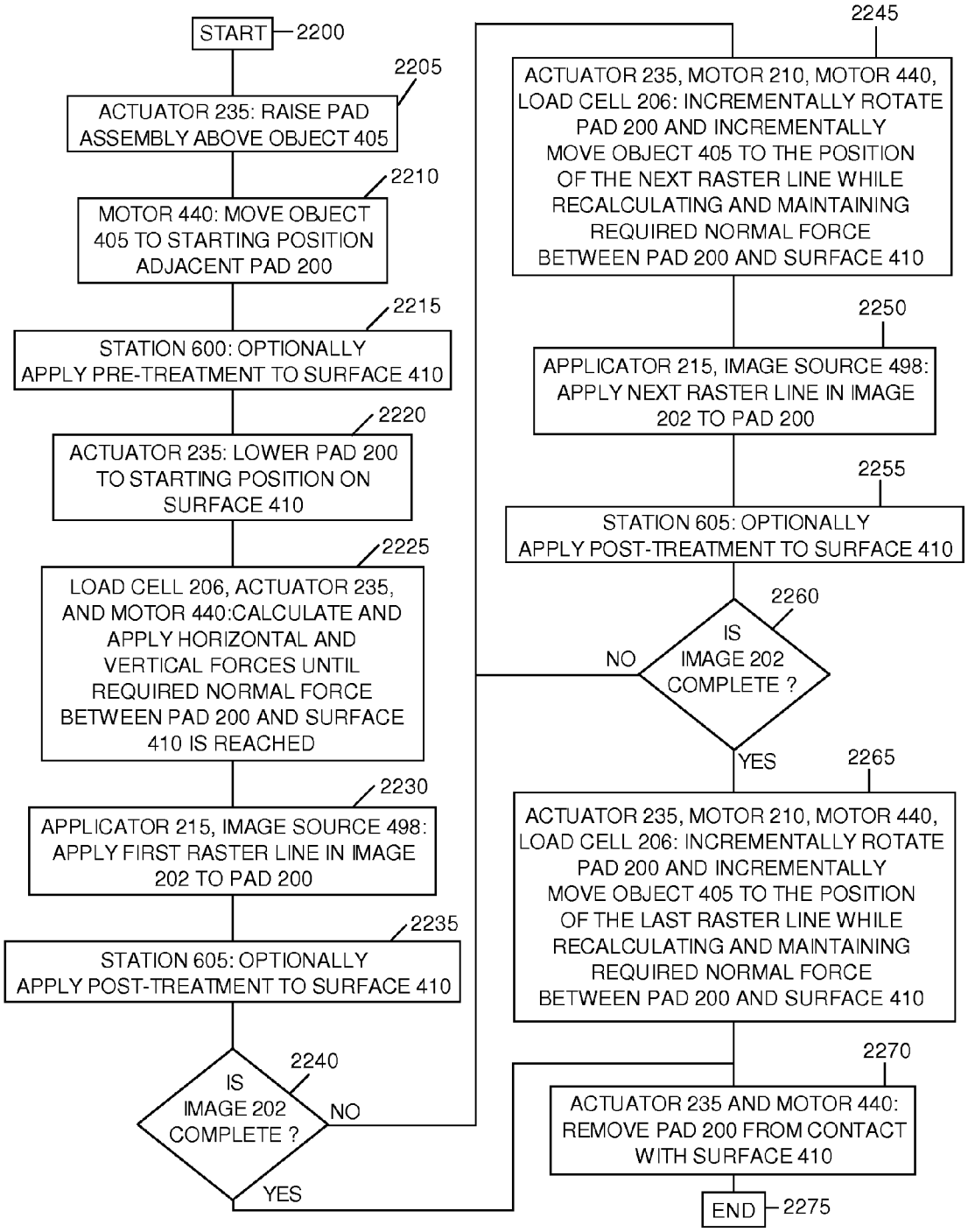
FIG. 6B is a flow chart showing the principal operation of the embodiment of FIG. 6A.

FIGS. 6A and 6B

FIG. 6A also illustrates one aspect of the first embodiment in use. An image source 498 delivers image information to controller 400 via connection 499. Controller 400 sends signals, via connection 455, to applicator 215. These signals cause applicator 215 to apply an ink or coating material or treatments 201 to the surface of wheel 200. Wheel 200 is brought into contact with surface 410 of object 405. Conveyor system 415 moves object 405 from right to left. Concurrently, the surface of wheel 200 rolls without slippage in contact with non-cylindrical surface 410 of object 405. Actuator 235 moves datum 225 up and down as necessary in order to keep wheel 200 in contact with surface 410 with a predetermined normal force as object 405 moves from right to left. The rotational speed of pad wheel 200 is normally constant, although variable speed operation can be used if desired. Motor 210 can turn wheel 200 in incremental or continuous motions.

It is typically required to maintain a constant normal force between the surface of wheel 200 and surface 410 as wheel 200 rotates. To accomplish this, load cell 206 senses horizontal, X, and vertical, Y, force components against wheel 200 as they are communicated through shaft 205 and motor 210. The normal force between pad wheel 200 and surface 410 of object 405 is given by the relationship F(normal)=[F(horizontal)cos θ]+[F(vertical) sin θ], where θ is the angle between the x-axis and the point on surface 410 in contact with wheel 200. These force components are analyzed by controller 400 and used to adjust forces applied by motor 440 and actuator 235. The magnitude of the normal force required can be between 0.01 and 100 kg, depending on the width of the image to be transferred, the durometer (Shore) hardness of pad 200, the contoured shape of surface 410, among other factors.

Image 202 (FIG. 5) applied to surface 410 by applicator 215 will appear normal, i.e. not distorted, as a viewer (not shown) moves along near surface 410. However, when a viewer stands at a distance from surface 410, so that most or all of surface 410 is seen, the image will appear distorted. When it is desired to view an undistorted image from such a distance, the image can be pre-distorted within image source 498. This is done by passing wheel 200 over surface 410, from one end to the other, in a "dry run" that permits image source 498 to record all the contours of surface 410. The image data within source 498 are then convolved with the shape of surface 410. I.e. the image is stretched along the x-axis in relatively flat, horizontal regions, and compressed along the y-axis in relatively steep, vertical regions. The new, convolved, image data are saved and used as source data for the image finally printed on surface 410.

FIG. 6B is a flow chart that shows the operation of the principal parts of controller 400. At the start of the printing process (block 2200), controller 400 instructs actuator 235 to raise the pad assembly comprising the various components supported by datum 225 above object 405 so that object 405 can freely move back and forth in the X-direction on conveyor 415 (block 2205). Next, controller 400 instructs motor 440 to move object 405 to a starting position adjacent pad 200 (block 2210). For purposes of this description, the starting position is at the sloped, left-hand end of object 405. An optional pretreatment can be applied to surface 410 by station 600 at this time (block 2215), as determined by controller 400 and data within image source 498. Next, controller 400 instructs actuator 235 to lower pad 200 to the starting position on surface 410 of object 405 (block 2220). Next, controller receives inputs representative of the x- and y-components of force between pad 200 and surface 410 of object 405 from load cell 206, via connection 207. These inputs are used to compute the required forces to be applied by motor 440 and actuator 235 in order to urge pad 200 against surface 410 with a predetermined normal force (block 2225). With pad 200 in position, a first raster line of image 202 (FIG. 5) is applied to pad 200 by source 215 (block 2230). After the first raster is applied, station 605 can optionally apply a post-treatment to surface 410 (block 2235). Next, controller 400 checks to see if image 202 (FIG. 4) is complete (block 2240). If image 202 and its optional post-treatment are complete, control moves to block 2270, causing actuator 235 and motor 440 to remove pad 200 from contact with surface 410, thereby ending the printing process (block 2275). All other operations by controller 400 are stopped at this point. If image 202 is not complete, controller 400 instructs motor 210 to incrementally rotate pad 200 to the position of the next raster line in image 202, while recalculating and maintaining the required normal force between pad 200 and surface 410 using motor 440 and actuator 235 (block 2245). As above, applicator 215 receives another raster line from image source 498 and causes applicator 215 to apply the raster to pad 200 (block 2250). After this is done, station 605 is optionally instructed by controller 400 to apply a post-treatment to surface 410 (block 2255). Controller 400 next determines if image 202 is complete (block 2260). If image 202 is not complete, control returns to block 2245. If image 202 is complete, controller 400 instructs motor 210 to rotate pad 200 in contact with surface 410 at the required normal force, supplied by motor 440 and actuator 235, until the last raster line in image 202 has been transferred to surface 410 (block 2265). After the last raster line has been transferred, actuator 235 and motor 440 remove pad 200 from contact with surface 410 (block 2270), thereby ending the printing process (block 2275).

Image 202 (FIG. 5) is applied at the top of pad 200, therefore image 202 must rotate on pad 200 some distance before being applied to surface 410 at the predetermined starting point. This distance can be accommodated by applying this portion of the image to pad 200 prior to the step in block 2220.

Pre- and post-treatments can be applied to one or many raster lines in image 202. More than one printing pass can be applied to object 405, if desired.

DESCRIPTION AND OPERATION

First Alternative Embodiment

FIGS. 7A through 9B

Figure 7A:
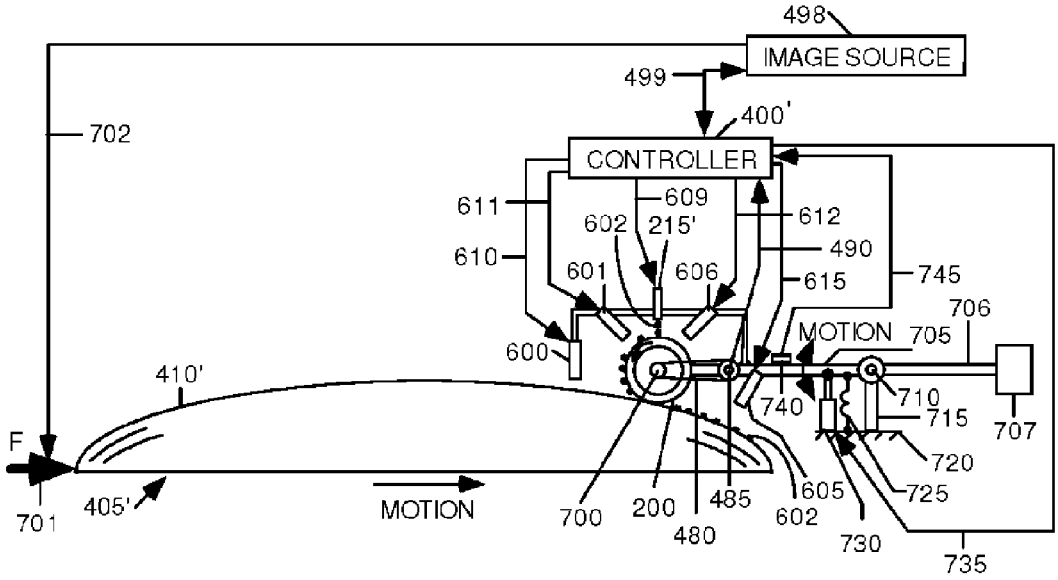
FIG. 7A shows a cross-sectional end view of the object and wheel of FIG. 7.

FIG. 7A shows a different aspect of the previous embodiment. In this embodiment a rotary pad is supported on a movable arm. A mechanism maintains constant force between the arm and the surface of the object being printed. Source 212 and conduit 214 (FIGS. 4-6A) are present in this aspect, but have been omitted from FIG. 7A for clarity. In this aspect, rolling pad wheel 200 is mounted on an axle 700. Axle 700 is rotatably secured to an arm 705 that is mounted on a pivot 710. Pivot 710 is supported on a plinth or platform 715 that is secured to a datum 720. A spring 725 provides a downward force on arm 705 in order to keep wheel 200 in firm, non-slipping contact with surface 410' of object 405'. An optional counterweight 707 attached to an extension 706 of arm 705 is used to reduce the force between wheel 200 and surface 410', if required. An optional force sensor 740, such as a strain gauge, is affixed to arm 705 and reports the force between wheel 200 and surface 410' to controller 400 via connection 745. An optional actuator 730 applies force between datum 720 and arm 705; actuator 730 acts under instructions from controller 400 that are sent via connection 735. When mechanism 730 is used, controller 400 constantly adjusts and maintains a constant force between surface 410' and wheel 200.

Object 405' is urged to the right of FIG. 7 by a mechanism such as motor 440 and conveyor 415 (FIG. 6A).

Rotary encoder 480 reports the angular position of wheel 200 to controller 400 via connection 490. Encoder 480 can alternatively be connected directly to shaft 700. As wheel 200 rotates, controller 400 receives positional information from encoder 485 and issues instructions to surface post-treatment station 605 via connection 615, wheel pretreatment station 606 via connection 612, applicator 215' via connection 609, wheel post treatment station 601 via connection 611, and surface pretreatment station 600 via connection 610. Inkjet head or applicator 215' emits ink droplets 602 in one or more colors onto the surface of wheel 200. As described above, pretreatment and post-treatment stations 600, 601, 605, and 606 can optionally apply liquids, vapors, sprays, and treatments such as UV, light, and infrared radiation, ultrasound, electrostatic charge, radioactive emissions, microwaves, and the like to surface 410' and any previously-applied layers on surface 410' in order to stabilize or enhance the image applied to surface 410'.

Figure 7B:
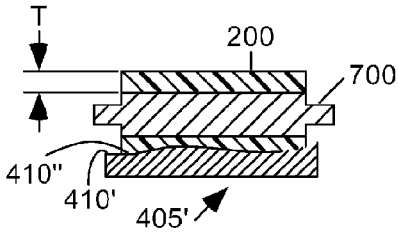
FIG. 7 shows a different aspect of the embodiment in FIGS. 4-6.

FIG. 7B shows a cross-sectional, end view of wheel 200 urged into compressive contact with surface 410' of object 405' by shaft 700. Surface 410' can be flat, as at 410", uneven, sloped, or a combination. The thickness, T, of the elastomeric surface of wheel 200 is greater than the vertical extent of the unevenness of surface 410' to be printed. Therefore, wheel 200 normally contacts surface 410' across the full width of wheel 200. Because of this contact, any ink or other coating that is on wheel 200 will come into contact with and transfer to surface 410'.

Figure 8:
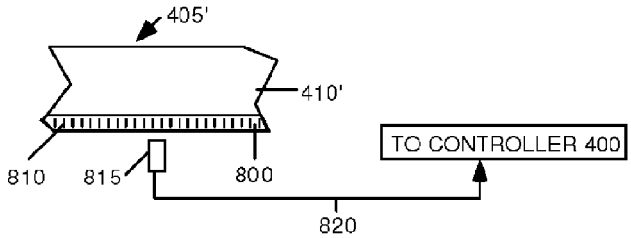
FIGS. 8 through 9A show optional additions to the embodiments in FIGS. 4-7.

FIG. 8 shows an optional aspect of the present embodiment. A strip of tape 800 having a series of marks 810 applied to surface 410' of object 405'. Marks 810 can be optically or magnetically sensed by a sensor 815. Sensor 815 reports the passing of each of marks 810 to controller 400. Marks 810 and sensor 815 replace or work with the function provided by optical encoder 485.

Figure 9A:
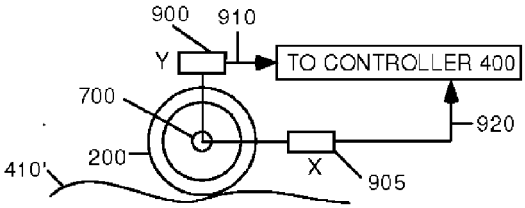

FIG. 9A shows another optional aspect of the present embodiment. Force sensors 900 and 905 are mechanically linked to shaft 700 of wheel 200 and report the orthogonal components of the force between wheel 200 and surface 410' to controller 400 via connections 910 and 920, respectively. An initial force value, FP, is input into controller 400 by an operator (not shown). Thereafter during printing, the servomechanism comprising controller 400, motive source 701, and actuator 730 acts to maintain the sum of the X and Y forces equal at the value FP. For example, when wheel 200 is printing on a rising or falling portion of surface 410', the vertical force applied by actuator 730 about pivot 710 is near zero and the horizontal force applied by source 701 is equal to FP.

Similarly, when wheel 200 is printing on a surface parallel to datum 720, force F, supplied by source 701 is near-zero, just sufficient to cause wheel 200 to rotate and perform its printing function, while the Y force supplied by actuator mechanism 730 is equal to FP, the desired printing force. When printing on a 45-degree angle, the X and Y forces applied by source 701 and actuator 730 (measured at shaft 700) are each equal to FP/2. The application of force normal to surface 410' ensures that there will be no slippage between the surface of wheel 200 and surface 410, thus smearing of the ink image is prevented.

Figure 9B:
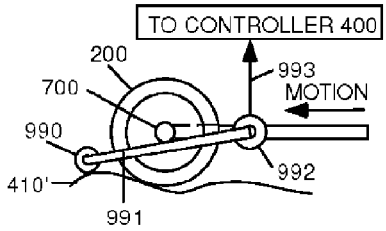

FIG. 9B shows another method for determining the slope of the surface being printed by wheel 200. A roller wheel 990 is mounted on an arm 991 that is secured to the shaft of a rotary encoder 992. As arm 990 rides up and down on surface 410', arm 991 causes the shaft of encoder 992 to rotate. Encoder 992 relays this angular information to controller 400 via connection 993. Controller 400 uses this angular information to maintain a constant rate of angular rotation of wheel 200 during printing onto surface 410'.

DESCRIPTION AND OPERATION

Second Alternative Embodiment

Figure 10:
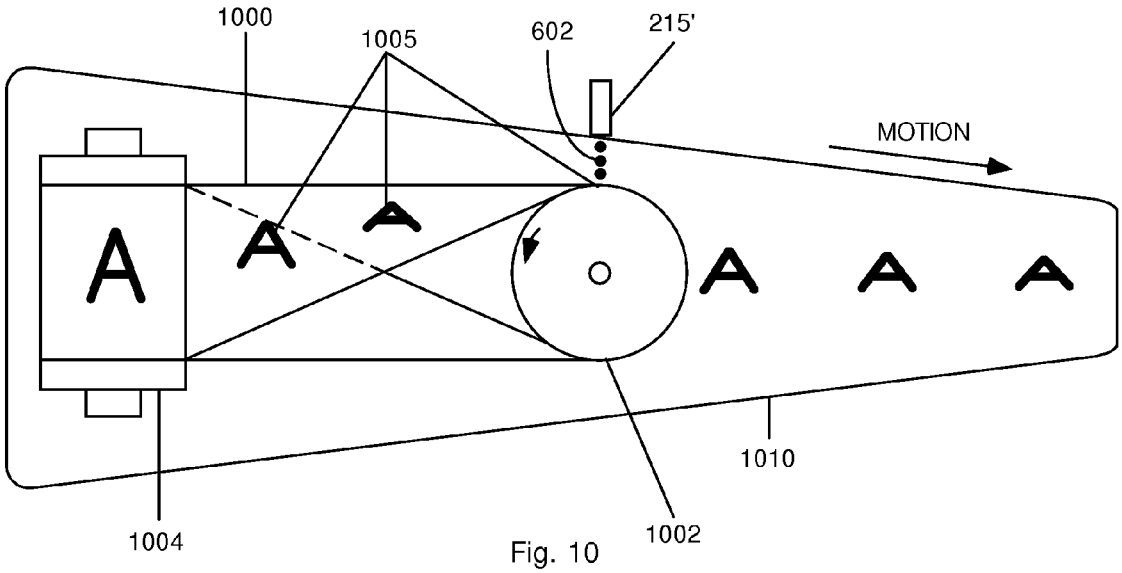
FIGS. 10 and 11 show a twisted belt embodiment.
Figure 11:
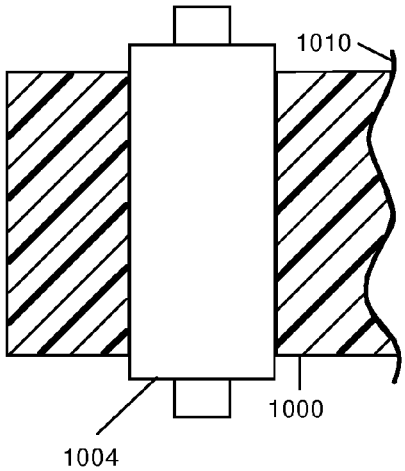

FIGS. 10 and 11

Many inkjet heads must be operated in a vertical position, jetting ink downward. Some applications require the application of images to vertical surfaces of objects that cannot be tilted.

FIG. 10 shows a printing system in which an image can be applied to a vertical surface of an object that cannot be tilted, such as a wall. A twisted-belt pad 1000 is used in an arrangement that accepts ink from inkjet head or applicator 215' that jets ink 602 vertically downward, forming characters or image 1005 onto the surface of belt 1000. Belt 1000 is suspended between two rollers 1002 and 1004. The axis of roller 1002 is oriented horizontally and the part of belt 1000 that is wrapped around roller 1002 is horizontal, as required by inkjet head or applicator 215'. The axis of roller 1004 is oriented vertically and the part of belt 1000 that is wrapped around roller 1004 is vertical, as required by the surface 1010 that is to receive image 1005 from belt 1000.

In operation, image 1005 is applied to surface 1010 as belt 1000 is compressed against surface 1010. While FIG. 10 shows an ink image 1000 being applied to surface 1005 while it is oriented vertically, surface 1005 can be oriented at any angle. Optionally, roller 1004 can pivot a required amount to conform to a surface of varying angle, i.e., the degree of twist of belt 1000 can be increased or decreased as required so that the portion of belt 1000 that wraps around roller 1004 will always be in a line contact with surface 1010. The angle of the axis of roller 1004 can change as the angle of surface 1010 changes so that roller 1004 is always in contact with surface 1010. The change in angle of axis 1004 can be in response to commands from controller 400 or simply urged into contact at any angle by mechanical contact with surface 1010.

While FIG. 10 shows surface 1010 moving relative to the inking assembly attached to roller 1004, FIG. 11 shows a cross-section of one possible configuration of surface 1010 with belt pad 1000 conforming to the curvature of surface 1010 in order to transfer image 1005.

DESCRIPTION AND OPERATION

Third Alternative Embodiment

FIGS. 12 through 15

Figure 12:
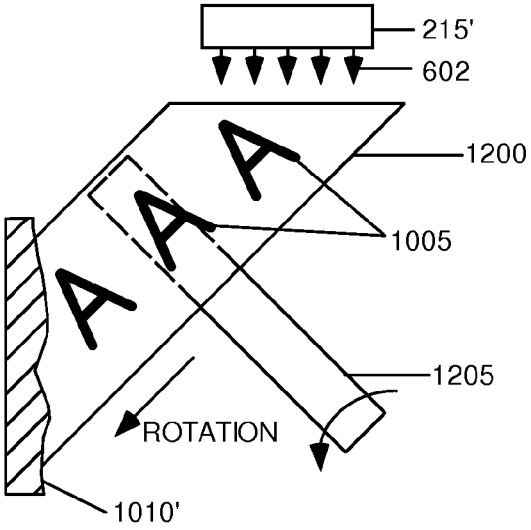
FIGS. 12 through 15 show the use of a conic transfer pad.

FIG. 12 shows an inkjet head or applicator 215' as it applies ink droplets 602 to a pad 1200. In this embodiment an ink image is applied to a conical wheel as the wheel is rotated against an irregular, non-horizontal surface. Pad 1200 has a conic section and is mounted on a rotary shaft 1205. When seen from a direction parallel to shaft 1205, pad 1200 has a circular shape. A rotary motive apparatus (not shown) rotates shaft 1205 and pad 1200 in the direction shown. Pad 1200 is rotated against a receiving surface 1010', transferring image 1005 to surface 1010'. Applicator 215' is located above pad 1200 so that ink droplets 602 are projected downward. The surface of pad 1200 is at an angle of 45 degrees with respect to the axis of shaft 1205. Surface 1010' is located on the opposite side of pad 1200 so that pad 1200 contacts surface 1010' after pad 1200 has rotated 180 degrees. Thus pad transfers image 1005 to surface 1010' while surface 1010' is vertical.

Figure 13:
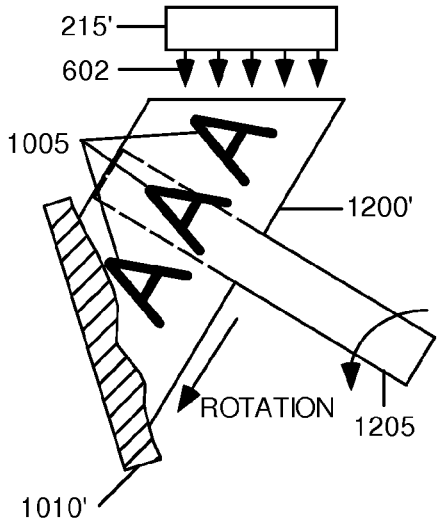

FIG. 13 shows a side view of pad 1200' with a surface that lies at an angle of about 30 degrees with respect to the axis of shaft 1205. Applicator 215' still sprays droplets 602 vertically downward, yet surface 1010' lies at an angle of about 15 degrees from vertical.

Figure 14:
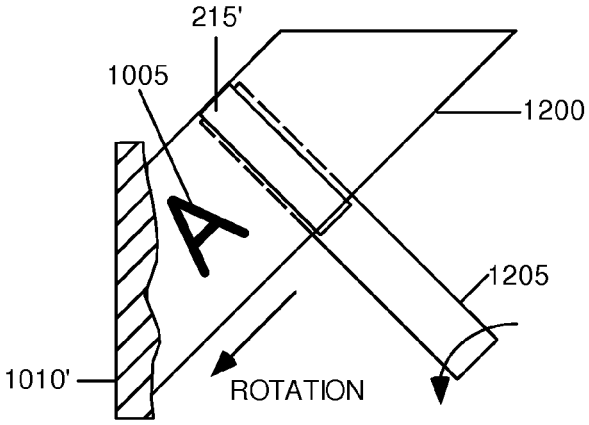

FIG. 14 shows a top view of pad 1200 and applicator 215'. In this case, surface 1010' contacts pad 1200 after pad has rotated 90 degrees from applicator 215'. Thus with applicator 215' oriented so that ink droplets 602 (not visible in this figure) are still sprayed downward, pad 1200 rotates against surface 1010' in a vertical direction.

Figure 15:
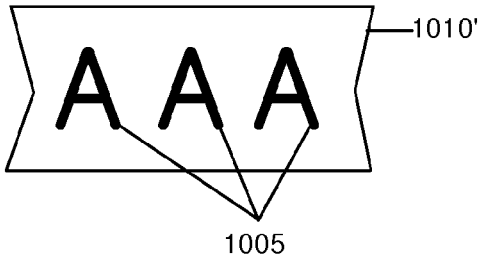

FIG. 15 shows the final image printed in each of the above cases. The image is identical in each case, yet the orientation of surface 1010' has varied from horizontal to vertical simply by modifying pad 1200 or by changing the angular position of surface 1010' with respect to head or applicator 215'. In all cases, head or applicator 215' remains oriented such that ink droplets 602 (FIGS. 12 and 13) are projected downwards.

Pad 1200 preferably is made of an elastomer such as silicone rubber, latex, caoutchouc, alginate, or another deformable material that can conform to an irregular surface, and can optionally be flattened and bulged as shown in our above-referenced pending applications.

DESCRIPTION AND OPERATION

Fourth Alternative Embodiment

Figure 16:
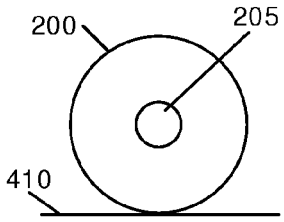
FIGS. 16 and 17 show a traction wheel embodiment.
Figure 17:
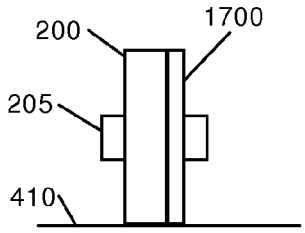

FIGS. 16 and 17

FIGS. 16 and 17 show side and front views, respectively of a pad wheel 200 and a traction wheel 1700 mounted on a shaft 205. In this embodiment a first pad wheel transfers ink to a surface, while a second wheel, located away from the area to be printed, provides friction against the surface. Ink (not shown) for printing onto surface 410 is present on wheel 200, and absent on wheel 1700. Traction wheel 1700 rides on surface 410 and provides additional frictional forces to turn wheel 200 on shaft 205. This can prevent slipping of wheel 200 and consequent smearing of the print image when wheel 200 is wet with ink.

DESCRIPTION AND OPERATION

Fifth Alternative Embodiment

FIGS. 18 through 21

Figure 18:
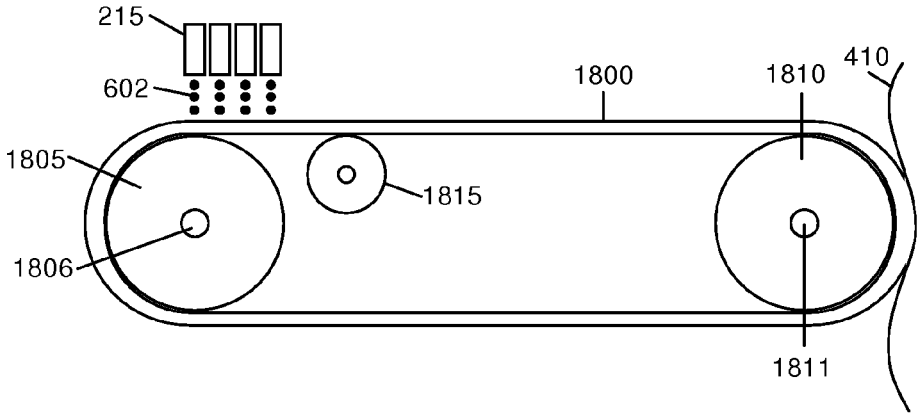
FIGS. 18 through 21 show a bulging belt embodiment.

FIG. 18 shows a belt transfer pad 1800 suspended between two rollers 1805 and 1810 and supported by an optional roller 1815. Roller 1805 turns on a shaft 1806. Roller 1810 turns on a shaft 1811. One or both of shafts 1806 and 1811 is connected to a rotary source (not shown) that drives belt 1800 around its path. All appropriate functions are under the control of a controller (not shown), similar to controller 400 shown above in connection with all the above embodiments. One or more inkjet head and treatment station applicators 215 is positioned above belt 1800. Applicators 215 deliver ink droplets 602 and other treatments and substances to belt 1800, as described in our co-pending application.

The surface of belt 1800 must be flat in order to receive ink from applicators 215, yet it must be bulged at the point of contact with surface 410 in order to prevent the uncontrolled release of trapped air (not shown) that would smear the transferred image (not shown).

The purpose of optional roller 1815 is to maintain belt 1800 in a level and flat condition during application of the image (not shown) comprising ink droplets 602.

Figure 19:
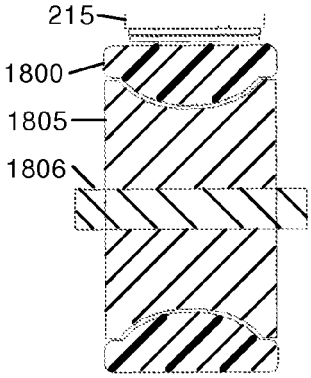

FIG. 19 is a cross-sectional view of pulley 1805 and belt 1800 beneath applicator 215. Pulley 1805 is contoured to receive the inside-facing contoured surface of belt 1800. Thus as belt 1800 passes over pulley 1805, the outer surface of belt 1800 is flat and can easily receive ink droplets from applicator 215.

Figure 20:
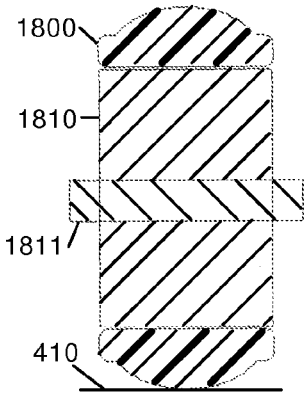

FIG. 20 is a cross-sectional view of pulley 1810 and belt 1800 as belt 1800 is prepared to transfer an ink image (not shown) to a receiving surface 410. Pulley 1810 has a flat surface that forces contoured belt 1800 to bulge outward. Thus the outer surface of belt 1800 is flat as belt 1800 passes over pulley 1805, and bulged as it passes over pulley 1810.

Figure 21:
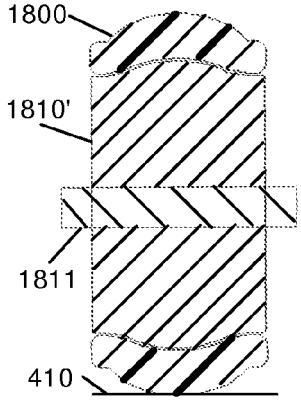

FIG. 21 shows an alternative shape for pulley 1810. Instead of a flat surface, pulley 1810' is crowned, forcing an even higher bulge of belt 1800.

As described in our co-pending patent application, the shapes of pulleys 1805 and 1810 can be changed by pneumatic, hydraulic, mechanical or other means.

Belt 1800 is made of flexible silicone rubber of Shore hardness between 10 and 50, although other hardnesses can be used. An internal webbing of a material such as nylon can be used to strengthen belt 1800 and prevent stretching, while still allowing bulging. Pulleys 1805 and 1810 are made of steel, aluminum, rubber, plastic, or a composite material.

CONCLUSIONS, RAMIFICATIONS, AND SCOPE

The embodiments shown of our improved pad printing method and apparatus incorporate an inking station and optional treatment stations that can move relative to a datum. An ink image is jetted downward onto a pad comprising a belt or roller and then the pad is brought into contact with a receiving surface that is flat, sloped, irregular, uneven, or undulating, thereby transferring the ink image to the surface while the ink jet assembly remains in a vertical, or near-vertical orientation. Optional pre- and post-treatments can also be applied to the receiving surface or to the pad. The optional treatments are applied by one or more stations comprising emissive and radiative sources, spray sources, vapor sources, and the like. These sources provide overcoats, undercoats, additional chemical reactants and catalysts, additional ink colors, heat, infrared, visible, and ultraviolet light, and flames. The embodiments shown enable multi-color printing in which the individual color components of an image must be registered only once as they are applied to the pad. A series of individual images can be printed that are the same or different, thereby enabling short printing runs or non-repeating decorative effects. Images that are longer than the circumference of the pad can be printed onto undulating and uneven surfaces, thereby enabling multi-color digital printing onto surfaces that are presently unprintable. Inkjet heads are oriented vertically so that they can jet downward at all times, thereby avoiding inconsistencies in print output.

While the above description contains many specificities, these should not be considered limiting but merely exemplary. Many variations and ramifications are possible. Instead of inkjet heads, spray heads can be used. Instead of inkjet technology, other printing methods such as electrostatic, dye transfer, sublimation, can be used. Wax, oil, solvent, and water-based inks can be used. Inks can cure by ultraviolet light activation, or by drying that is assisted by air flow, or application of heat or flame. Instead of using an actuator for wildly undulating surfaces, a simple weight can be used to hold the pad wheel against a gently undulating receiving surface.

While the present system employs elements which are well known to those skilled in the art of pad printing, it combines these elements in a novel way which produces one or more new results not heretofore discovered. Accordingly the scope of this invention should be determined, not by the embodiments illustrated, but by the appended claims and their legal equivalents.

The invention claimed is:

1. A surface-tracking, rotary pad printing system for printing onto a surface of an object, comprising:

a controller for operating said surface-tracking, rotary pad printing system, an image source for providing an image, a pad, said pad being rotatably mounted, a motive source responsive to said controller that causes said pad to rotate, a load cell connected to said pad and arranged to sense horizontal and vertical force components against said pad and arranged to supply a signal representative of said horizontal and vertical force components to said controller, a source of ink, an ink applicator connected to said source of ink and said controller and said image source, said ink applicator being arranged to apply ink from said source of ink in the form of a representation of said image directly onto said pad, an actuator connected to said controller and arranged to urge said pad against said surface of said object with a constant normal force and thereby causing said pad to remain in contact with said surface of said object as said pad rotates, said controller arranged to receive said signal representative of said horizontal and vertical force components from said load cell, said controller containing instructions that cause said force components to actuate said motive source and said actuator in a predetermined fashion so that said pad remains in constant contact with said surface of said object while said pad rotates, said ink being arranged to adhere preferentially to said surface of said object rather than said pad, so that said ink transfers from said pad to said surface of said object at the region of contact between said pad and said surface of said object and adheres to said object, whereby said ink applicator applies said image to said pad while said pad rotates in contact with said surface, and said image is transferred from said pad to said surface of said object as said pad rotates in contact with said surface of said object in a single transfer step, thereby printing said image onto said surface of said object without multiple transfers.

2. The system of claim 1, further including at least one treatment station for applying a coating to said surface of said object.

3. The system of claim 1, further including at least one station capable of applying to said surface of said object at least one treatment selected from the group consisting of ionizing radiation, electromagnetic radiation, heat, gas, and ultrasound.

4. The system of claim 1, further including rotary encoder means arranged to report an angular position of said pad to said controller in order that said controller can cause said source of ink to apply said image to said pad prior to transfer of said image to said surface.

5. The system of claim 1 wherein said source of ink is arranged to supply inks having a plurality of colors.

6. The system of claim 1 wherein a shape of said surface is selected from the group consisting of flat, uneven, and sloped surfaces.

7. The system of claim 1 wherein said pad is made of an elastomeric material selected from the group consisting of silicone rubber, caoutchouc, latex, gelatin, and alginate.

8. The system of claim 1, further including said load cell sensing and reporting at least one force component acting on said pad to said controller.

9. A method for contour pad printing, comprising:

providing a surface, providing an image source for supplying an image, providing an activatable controller containing instructions for contour pad printing onto said surface, providing sensing means connected to said controller for sensing X and Y components of force between said surface and said pad, providing a pad, said pad being rotatably mounted, providing a motive source for rotating said pad, providing a source of ink, providing an applicator connected to said controller, said image source, and said source of ink for applying said image containing said ink to said pad, providing an actuator connected to said controller and arranged to provide a normal force between said pad and said surface for urging said pad into contact with said surface as said pad rotates, activating said controller so that said controller:

(a) receives from said sensing means said X and Y components of force between said surface and said pad, (b) causes said actuator to urge said pad against said surface with a normal force so that said pad rotates in contact with said surface, (c) causes said applicator to receive said image from said image source and apply said image containing said ink from said ink source directly to said pad while said rotary motive source urges said pad to rotate, whereby said image is printed directly onto said pad while said pad rotates in contact with said surface with a predetermined normal force having X and Y components sensed by said sensing means and then said image is transferred from said pad to said surface in a single transfer step, thereby avoiding image degradation due to multiple transfers of said image.

10. The method of claim 9, further including at least one treatment station for applying a coating to said surface.

11. The method of claim 9, further including at least one station for_applying to said surface at least one treatment selected from the group consisting of ionizing radiation, electromagnetic radiation, heat, gas, and ultrasound.

12. The method of claim 9, further including rotary encoder means arranged to report an angular position of said pad to said controller in order that said controller can cause said source of ink to apply said image to said pad prior to transfer of said image to said surface.

13. The method of claim 9 wherein said source of ink is supplied with inks in a plurality of colors.

14. The method of claim 9 wherein a shape of said surface is selected from the group consisting of flat, uneven, and sloped surfaces.

15. The method of claim 9 wherein said pad is made of an elastomeric material selected from the group consisting of silicone rubber, caoutchouc, latex, gelatin, and alginate.

16. A system for pad printing an image onto a surface, comprising:

controller means, an image source connected to said controller means for supplying said image, a pad, said pad being rotatably mounted, a motive source for rotating said pad, a source of ink, applicator means connected to said controller means and said source of ink and said image source for applying a reverse copy of said image containing said ink directly to said pad without use of an intermediate release surface, sensing means connected to said controller means for sensing X and Y components of force between said surface and said pad, actuator means connected to said controller means and arranged to provide a normal force between said pad and said surface_for urging said pad against said surface, wherein said surface is non-cylindrical, said controller means being arranged to:

(a) receive said X and Y components of force between said surface and said pad from said sensing means, (b) receive said image from said image source (c) cause said applicator means to apply said image to said pad while also causing said motive source to rotate said pad, and (d) cause said actuator means to urge said pad against said surface with a predetermined normal force comprising said X and Y components, whereby when said actuator means causes said pad to rotate in contact with said surface at a predetermined normal force and said image is applied to said pad and then transferred to said surface with a single transfer step.

17. The system of claim 16, further including at least one treatment station for applying a coating to said surface.

18. The system of claim 16, further including at least one station for applying to said surface at least one treatment selected from the group consisting of ionizing radiation, electromagnetic radiation, heat, gas, and ultrasound.

19. The system of claim 16, further including rotary encoder means arranged to report an angular position of said pad to said controller in order that said controller can cause said source of ink to apply said image to said pad prior to transfer of said image to said surface.

20. The system of claim 16 wherein said source of ink is supplied with inks in a plurality of colors.

21. The system of claim 16 wherein a shape of said surface is selected from the group consisting of flat, uneven, and sloped surfaces.

22. The system of claim 16 wherein said pad is made of an elastomeric material selected from the group consisting of silicone rubber, caoutchouc, latex, gelatin, and alginate.

* * * * *